US009541343B2

(12) United States Patent
Dodson

(10) Patent No.: US 9,541,343 B2
(45) Date of Patent: Jan. 10, 2017

(54) INTERCHANGEABLE CHAMBER AND BARREL SYSTEM

(71) Applicant: James A. Dodson, Johnstown, PA (US)

(72) Inventor: James A. Dodson, Johnstown, PA (US)

( * ) Notice: Subject to any disclaimer, the term of this patent is extended or adjusted under 35 U.S.C. 154(b) by 87 days.

(21) Appl. No.: 14/601,545

(22) Filed: Jan. 21, 2015

(65) Prior Publication Data

US 2016/0209155 A1 Jul. 21, 2016

(51) Int. Cl.
*F41A 21/02* (2006.01)
*F41A 21/12* (2006.01)
*F41A 21/48* (2006.01)

(52) U.S. Cl.
CPC ..... *F41A 21/12* (2013.01); *F41A 21/02* (2013.01); *F41A 21/482* (2013.01)

(58) Field of Classification Search
CPC ..... F41A 21/12; F41A 21/02
See application file for complete search history.

(56) References Cited

U.S. PATENT DOCUMENTS 2,736,118 A * 2/1956 Clarkson et al. ..... F41A 21/12 42/75.02
2,736,119 A * 2/1956 Clarkson et al. ..... F41A 21/12 42/75.02
2,992,596 A * 7/1961 Hammer ..... F41A 21/12 42/76.01
3,054,110 A 9/1962 Walker
3,411,229 A * 11/1968 Gronemann ..... F41A 5/24 42/76.01
3,611,611 A 10/1971 Quinney
3,656,250 A 4/1972 Brown
3,845,581 A * 11/1974 Infantino ..... F41A 21/12 42/76.01
3,858,342 A * 1/1975 Langsford ..... F41A 21/12 42/16
3,883,997 A 5/1975 Burlingame
3,943,821 A * 3/1976 Seifried ..... F41A 21/12 89/16
3,990,169 A 11/1976 Jennie
4,455,777 A 6/1984 Callies
4,702,027 A * 10/1987 Stanley ..... F41A 21/12 42/76.02
5,479,737 A * 1/1996 Osborne ..... F41A 21/12 42/76.01
6,357,331 B1 * 3/2002 Dionne ..... F41A 11/02 42/77
6,609,323 B1 8/2003 Donnelly
(Continued)

FOREIGN PATENT DOCUMENTS

GB 720684 A * 12/1954 ..... F41A 21/12

*Primary Examiner* — Stephen M Johnson
*Assistant Examiner* — Joshua Semick
(74) *Attorney, Agent, or Firm* — Neustel Law Offices; Michael S. Neustel

(57) ABSTRACT

An interchangeable chamber and barrel system for allowing an end user to easily change a chamber body and/or a barrel for a firearm without the assistance of a gunsmith. The interchangeable chamber and barrel system generally includes an interchangeable chamber body having a chamber that is removably connectable to a receiver of a firearm and an interchangeable barrel that is removably connected to the chamber body opposite of the receiver. The chamber body and/or the barrel may be changed on the firearm at any time based on the preference of the end user.

22 Claims, 12 Drawing Sheets

(56) References Cited

U.S. PATENT DOCUMENTS

| | | | | |
|---|---|---|---|---|
| 7,823,314 | B1 | 11/2010 | Wheatley | |
| 8,739,450 | B2 * | 6/2014 | Piontek ..... | F41A 21/10 42/77 |
| 8,791,326 | B2 | 7/2014 | Sampson | |
| 2004/0088897 | A1 | 5/2004 | Braverman | |

* cited by examiner

INTERCHANGEABLE CHAMBER AND BARREL SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a firearm barrel and more specifically it relates to an interchangeable chamber and barrel system for allowing an end user to easily change a chamber body and/or a barrel for a firearm without the assistance of a gunsmith.

Description of the Related Art

Any discussion of the related art throughout the specification should in no way be considered as an admission that such related art is widely known or forms part of common general knowledge in the field.

A conventional gun barrel is an elongated single piece of metal with a chamber that receives the ammunition cartridge and a bore that receives the fired bullet of the ammunition. The barrel of a rifle becomes damaged after repeated firings due to various factors including the heat generated to propel the bullet through the bore of the barrel and wear by the bullet passing through the bore. After repeated usage, the rifling in the bore is diminished thereby reducing the accuracy of the rifle. When the rifling in the bore has deteriorated, the barrel is often times referred to as "shot out". In addition, cracks, pits and fissures can develop at the rear end of the bore where the heat is the most intense sometimes referred to as the "throat" of the barrel. If the user wants the rifle to shoot accurately at a target, the barrel needs to be replaced. In addition, if the user of the rifle wants to change the caliber of bullet fired they need to replace the barrel which has the appropriate sized chamber and bore.

To replace a rifle barrel and/or change a chamber, a gunsmith is needed to machine the barrel to fit the action and to cut the chamber in the barrel itself. Hence, replacing a rifle barrel is expensive and time consuming depending upon the backload of work the gunsmith has which is sometimes 6 months to 12 months. The end user of the rifle is therefore not able to use the firearm until the new barrel is fabricated and installed by the gunsmith.

To further complicate matters, it is difficult for a gunsmith to accurately machine a chamber and a bore into a barrel. Since the throat of the bore has to be cut one or more inches into the barrel because of the chamber, it is difficult to maintain concentricity between the throat of the bore and the chamber because cutting into the barrel several inches often times cuts off center because bores typically have a curvature to them. Because of the resulting curvature of the bore and the throat of the bore, the barrel has a decreased accuracy and increased inconsistency. Furthermore, because the curvature of the bore is different for each gun barrel is different, a new barrel will not shoot the same as the prior barrel on the firearm.

In addition, machining costs for a new gun barrel are higher for a gunsmith because they are not able to use a CNC (computer numerical code) machine for machining the chamber. In addition, if the barrel, the bore and/or the chamber is damaged during the machining of the gun barrel, the entire gun barrel must be discarded resulting in wasted material and time.

Because of the inherent problems with the related art, there is a need for a new and improved interchangeable chamber and barrel system for allowing an end user to easily change a chamber body and/or a barrel for a firearm without the assistance of a gunsmith.

BRIEF SUMMARY OF THE INVENTION

The invention generally relates to an interchangeable chamber and barrel system which includes an interchangeable chamber body having a chamber that is removably connectable to a receiver of a firearm and an interchangeable barrel that is removably connected to the chamber body opposite of the receiver. The chamber body and/or the barrel may be changed on the firearm at any time based on the preference of the end user.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
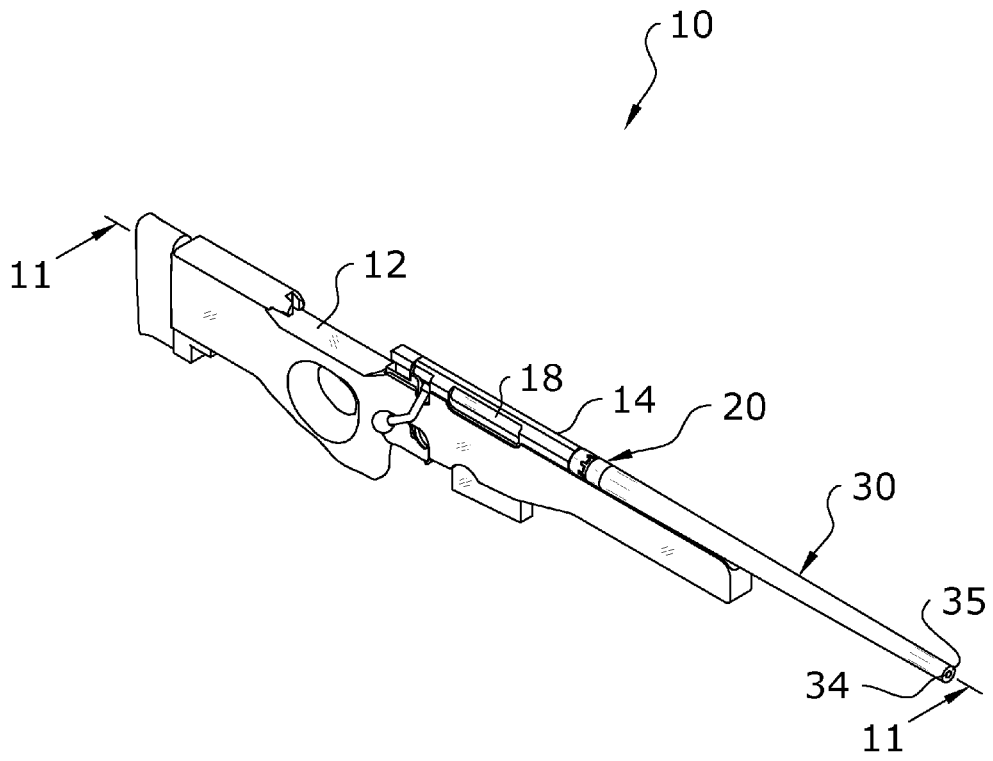
FIG. 1 is an upper perspective view of the present invention fully assembled as part of a firearm.

Turning now descriptively to the drawings, in which similar reference characters denote similar elements throughout the several views, FIGS. 1 through 13 illustrate an interchangeable chamber and barrel system 10, which comprises an interchangeable chamber body 20 having a chamber 24 that is removably connectable to a receiver 14 of a firearm and an interchangeable barrel 30 that is removably connected to the chamber body 20 opposite of the receiver 14. The chamber body 20 and/or the barrel 30 may be changed on the firearm at any time based on the preference of the end user. The chamber body 20 is preferably constructed of a first unitary piece of metal and the barrel 30 is preferably constructed of a second unitary piece of metal that is manufactured separate of the first unitary piece of metal. It is further preferable that the chamber body 20 and the barrel 30 are manufactured using a CNC machine to assist in reducing manufacturing costs.

The present invention may be utilized with various types of firearms including, but not limited to, rifles, pistols and shotguns. The present invention may also be utilized in bolt 18 action, lever action, pump action, revolver or semi-automatic types of firearms. The present invention may also be utilized with various types of gun barrels 30 including, but not limited to, smoothbore 33 and rifled.

B. Interchangeable Chamber Body

Figure 2:
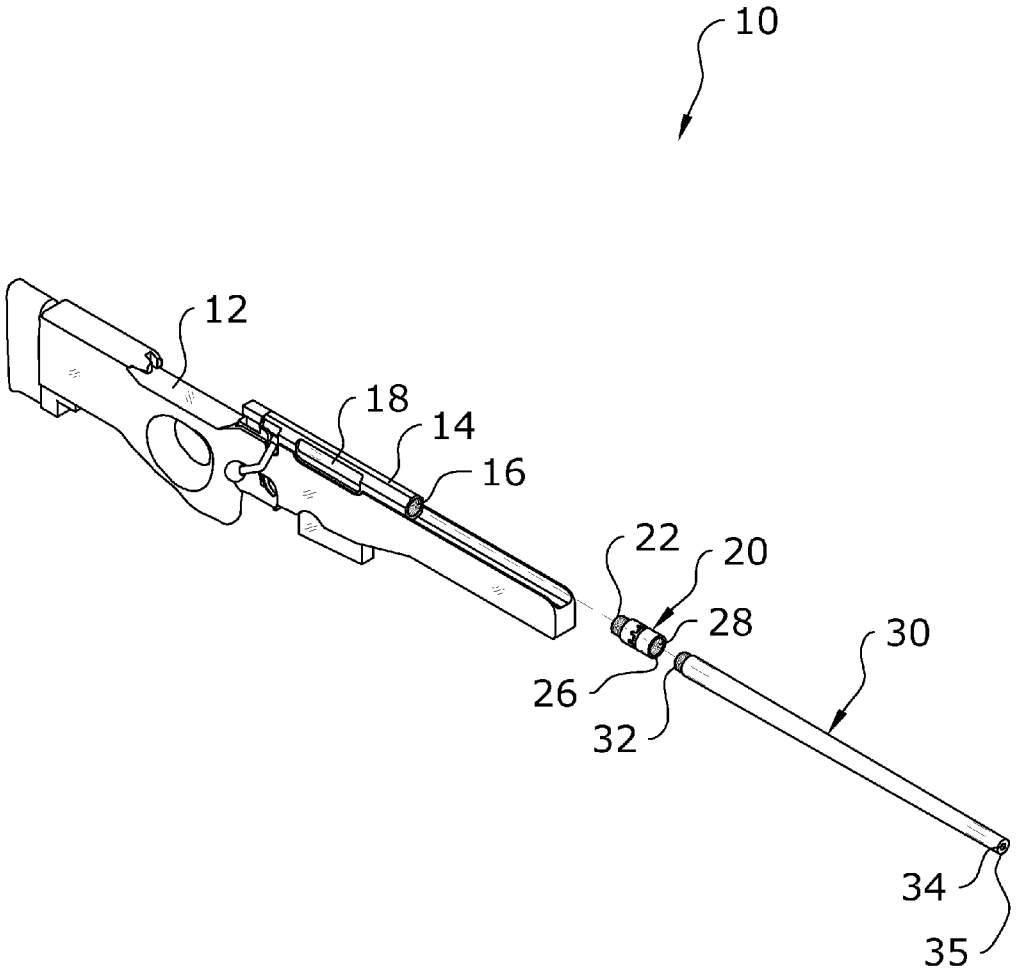
FIG. 2 is an exploded upper perspective view of the present invention with respect to a firearm.

The chamber body 20 has a first end 22 and a second end 26 as illustrated in FIGS. 3 through 8 of the drawings. The first end 22 of the chamber body 20 is removably attachable to the receiver 14 of the firearm thereby allowing removal and changing of the chamber body 20 with respect to the rifle. The first end 22 of the chamber body 20 is preferably removably attached to a receiver opening 16 within the receiver 14 as illustrated in FIGS. 1 and 2 of the drawings. The receiver 14 is attached to the firearm body 12 (e.g. wood, composite, metal) and the receiver 14 houses many of the moving components of the rifle as illustrated in FIGS. 1 and 2 of the drawings. For example, one type of rifle uses a bolt 18 with a lever that is rotatably and slidably positioned within the receiver 14 to extend an ammunition cartridge 19 into the chamber 24 of the chamber body 20 and to retract the ammunition cartridge 19 from the chamber 24.

Figure 6:
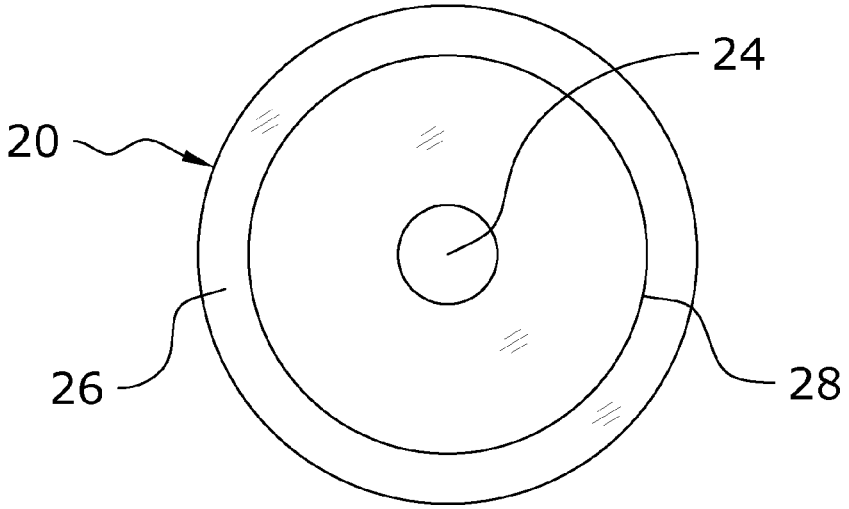
FIG. 6 is an end view of the chamber body illustrating the outer opening.
Figure 7:
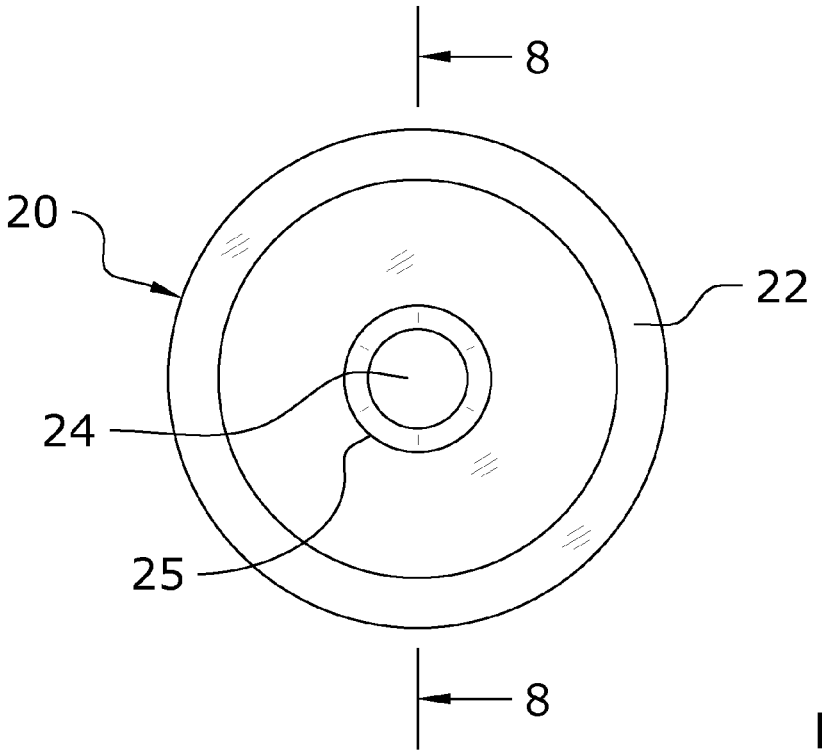
FIG. 7 is an end view of the chamber body illustrating the chamber.

The chamber body 20 has an elongated structure with a concentric longitudinal axis. The external cross sectional shape of the chamber body 20 is preferably circular as best illustrated in FIGS. 6 and 7 of the drawings, but may have various other types of shapes (e.g. square, rectangular, oval). The length of the chamber body 20 measured from the first end 22 to the second end 26 is at least the length of the chamber 24 combined with the length required for the end connectors which are discussed herein. The chamber body 20 is constructed of a rigid material such as, but not limited to, metal. The chamber body 20 is preferably manufactured using a CNC machine or other efficient machining process.

The first end 22 of the chamber body 20 includes a first connector that is adapted to be removably connected to a receiver 14 of a firearm thereby allowing the interchangeability of the chamber body 20 with respect to the firearm. The first connector may be comprised of any connector device suitable for securely attaching the chamber body 20 in a non-movable manner to the receiver 14 of the firearm to prevent movement during firing of the firearm and that also allows for releasing of the chamber body 20 from the receiver 14 when the user desires to change the chamber body 20 on the firearm. It is preferable that the first connector is comprised of a threaded structure that threadably connects to a corresponding threaded structure on the receiver 14. It is further preferable that the first connector is comprised of outer threading 23 surrounding at least a portion of the first end 22 that is adapted to threadably connect to a corresponding interiorly threaded receiver opening 16 in the receiver 14. It can be appreciated that an end of the receiver 14 may have exterior threading and the first connector for the first end 22 has interior threading 29 that threadably connect to one another alternatively.

The second end 26 of the chamber body 20 includes a second connector that is adapted to be removably connected to an inner connector of the inner end 31 of the barrel 30, wherein the inner end 31 of the barrel 30 is at the end of the barrel 30 opposite of the muzzle end 35.

The second connector may be comprised of any connector device suitable for securely attaching the barrel 30 in a non-movable manner to the chamber body 20 to prevent movement during firing of the firearm and that also allows for releasing of the barrel 30 from the chamber body 20 when the user desires to change the barrel 30 on the firearm. It is preferable that the second connector is comprised of a threaded structure that threadably connects to a corresponding threaded structure on the receiver 14. It is further preferable the second connector is comprised of interior threading 29 within the second opening 28 and wherein the inner connector of the barrel 30 is comprised of outer threading 32 23 that threadably connects to the interior threading 29 of the second connector. However, it can be appreciated that the second connector may be comprised of exterior threading surrounding at least a portion of the second end 26 that is adapted to threadably connect to a corresponding interiorly threaded opening in the inner end 31 of the barrel 30.

Figure 3:
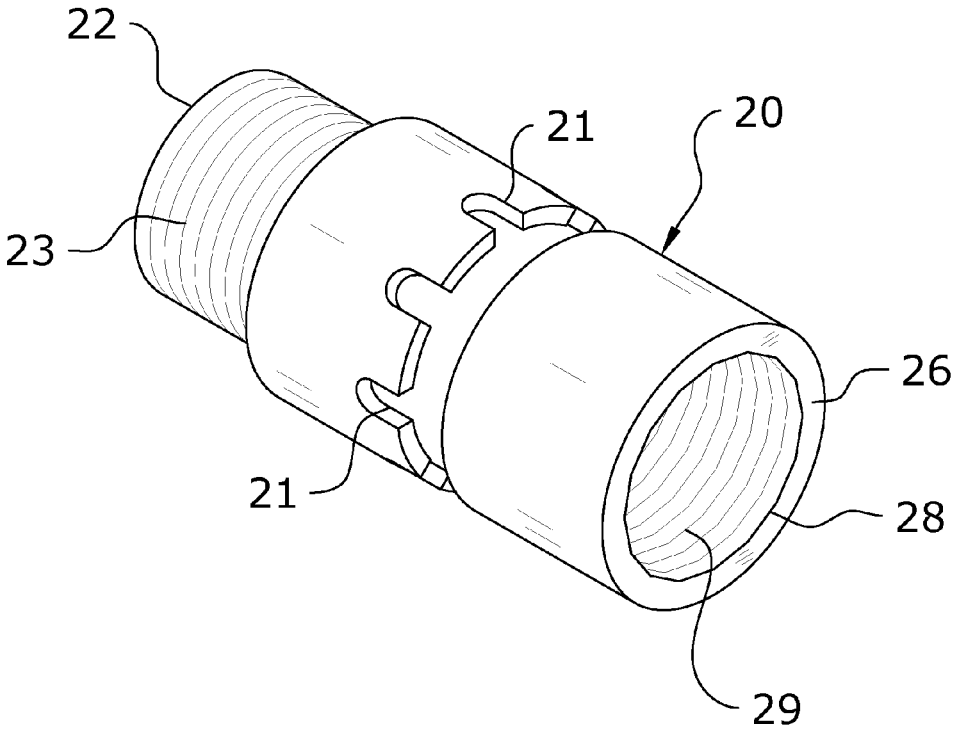
FIG. 3 is an upper perspective view of the chamber body illustrating the outer opening.
Figure 4:
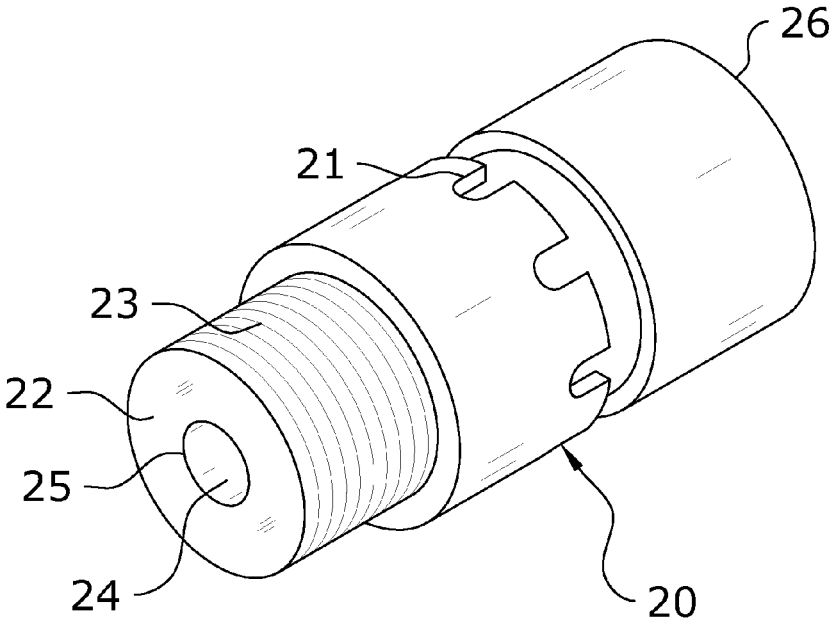
FIG. 4 is an upper perspective view of the chamber body illustrating the opening to the chamber.
Figure 5:
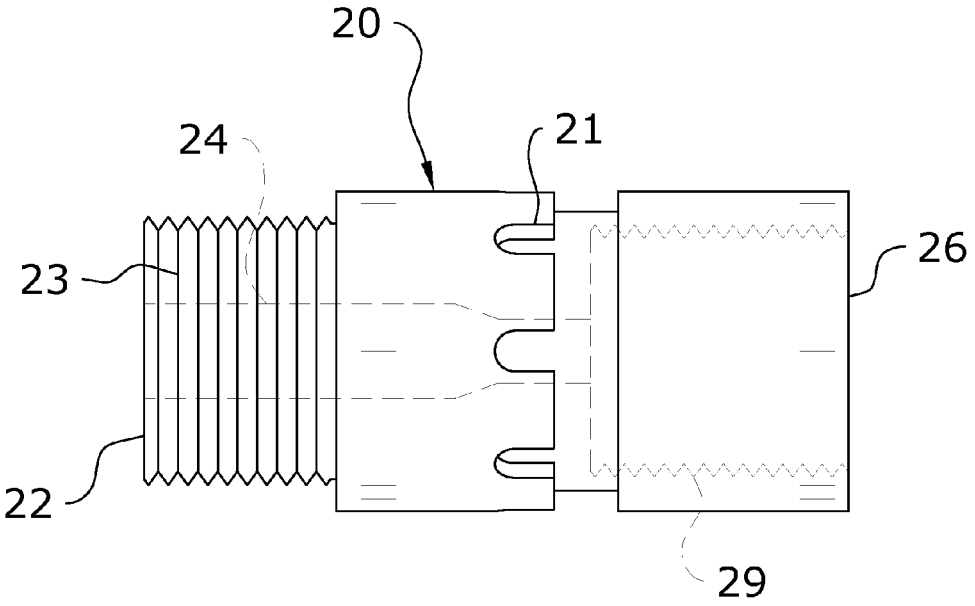
FIG. 5 is a side view of the chamber body.

As shown in FIGS. 3 through 4 of the drawings, the chamber body 20 preferably includes a plurality of gripping members 21 for selective engagement by a tool such as, but not limited to, a spanner wrench. Various other structures may be used on the chamber body 20 to allow for tightening and removal of the chamber body 20 with respect to the receiver 14 of the firearm.

Figure 8:
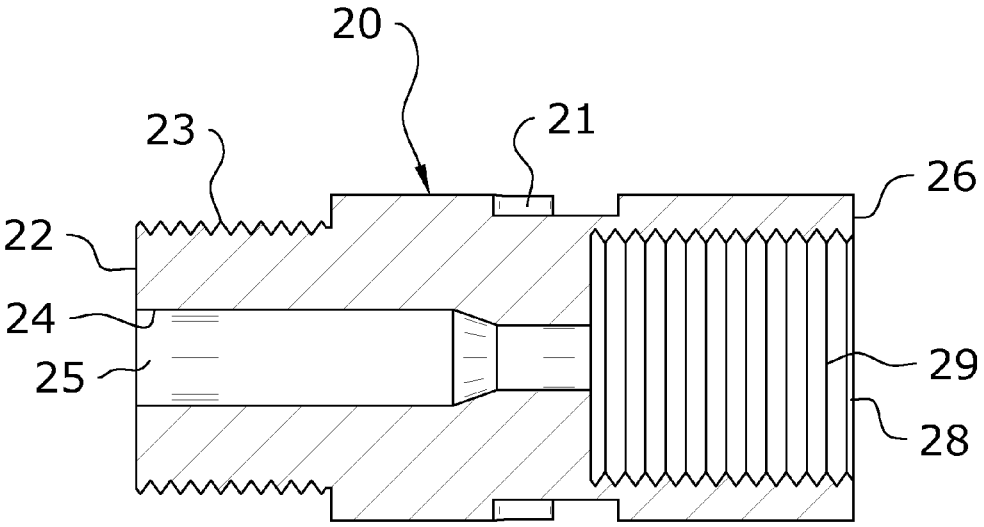
FIG. 8 is a cross sectional view taken along line 8-8 of FIG. 7.

A first opening 25 extends into the first end 22 of the chamber body 20 as best illustrated in FIGS. 4 and 7 of the drawings. The first opening 25 has a diameter sufficient to receive the caliber of ammunition cartridge 19 intended to be used on the firearm. A chamber 24 is within the chamber body 20 and is connected to the first opening 25. The chamber 24 has a size and shape designed to snugly receive the caliber of ammunition cartridge 19 intended to be used on the firearm as best illustrated in FIG. 8 of the drawings. The chamber 24 receives at least a portion of the ammunition cartridge 19.

A second opening 28 extends into the second end 26 of the chamber body 20 opposite of the first opening 25, wherein the second opening 28 is connected to the first opening 25 by the chamber 24. The second opening 28 extends inwardly to a distal end of the neck of the chamber 24 as illustrated in FIG. 8. The diameter of the second opening 28 is preferably larger than a diameter of the neck of the chamber 24 as illustrated in FIGS. 6 and 8 of the drawings.

It can be appreciated that the first opening 25 may be part of the chamber 24 to provide a consistent diameter from the first opening 25 to the body portion of the chamber 24 as illustrated in FIG. 8. The chamber 24 further includes a tapering shoulder that reduces the diameter of the passage to the size of the neck of the chamber 24 as further shown in FIG. 8 of the drawings. The first opening 25, the chamber 24, the second opening 28 and the bore 33 of the barrel 30 are concentric when the receiver 14, chamber body 20 and barrel 30 are connected together.

C. Interchangeable Barrel

Figure 9:
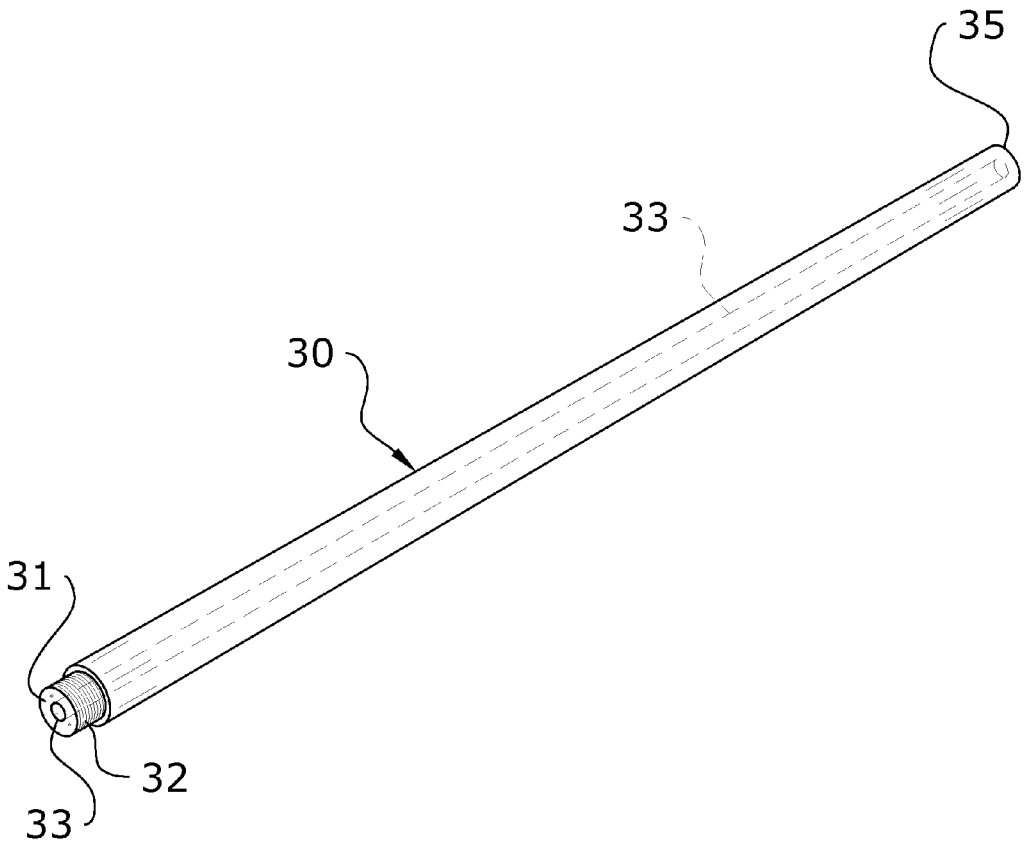
FIG. 9 is an upper perspective view of the barrel illustrating the inner end and the bore.

The barrel 30 has an inner end 31, a muzzle end 35 opposite of the inner end 31 and a bore 33 extending between the inner end 31 and the muzzle end 35 as illustrated in FIGS. 2 and 9 of the drawings. The barrel 30 may have various lengths used for various types of firearms such as rifles and pistols. The barrel 30 is preferably constructed of a unitary piece of metal, but various other types of suitable materials may be utilized to construct the barrel 30.

The bore 33 extends through the inner end 31 to the muzzle end 35 of the barrel 30 through a discharge opening 34 that releases the bullet and is preferably concentric with respect to the barrel 30. The bore 33 has a diameter sized to the caliber of bullet being fired through the bore 33. The bore 33 of the barrel 30 is preferably rifled having a plurality of helical lands and helical grooves.

The barrel 30 is comprised of an elongated structure having a longitudinal axis. The barrel 30 may have various cross sectional shapes such as conventional gun barrels 30, but it is preferable that the barrel 30 has a circular cross sectional shape.

The inner connector may be comprised of any connector device suitable for securely attaching the barrel 30 in a non-movable manner to the chamber body 20 to prevent movement during firing of the firearm and that also allows for releasing of the barrel 30 from the chamber body 20 when the user desires to change the barrel 30 on the firearm. It is preferable that the inner connector is comprised of a threaded structure that threadably connects to a corresponding threaded structure on the receiver 14. It is further preferable that the inner connector is comprised of outer threading 32 surrounding at least a portion of the inner end 31 of the barrel 30 that is adapted to threadably connect to corresponding interior threading 29 of the second opening 28 within the chamber body 20. It can be appreciated that the second end 26 of the chamber body 20 may have exterior threading and the inner connector for the inner end 31 of the barrel 30 is comprised of an interiorly threaded opening extending into the inner end 31 of the barrel 30 that threadably connects to the exterior threading.

D. Operation of Preferred Embodiment

Figure 10:
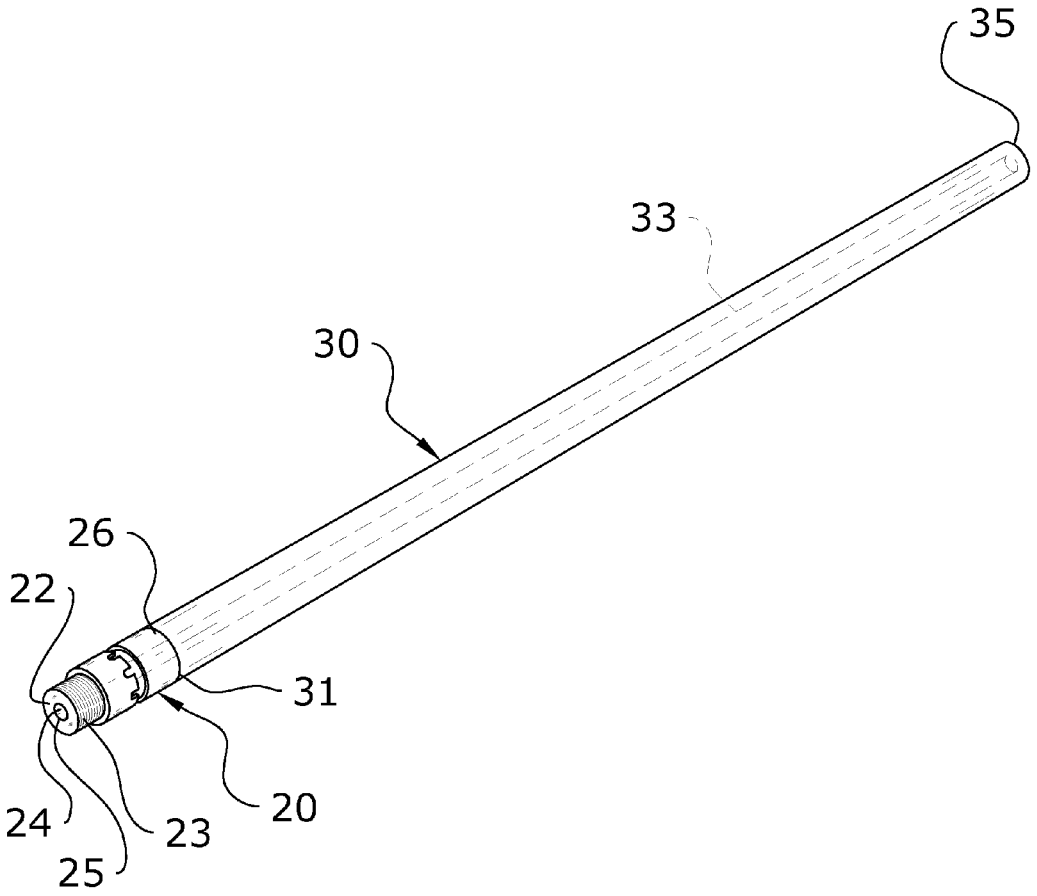
FIG. 10 is an upper perspective view of the chamber body attached to the barrel.
Figure 11:
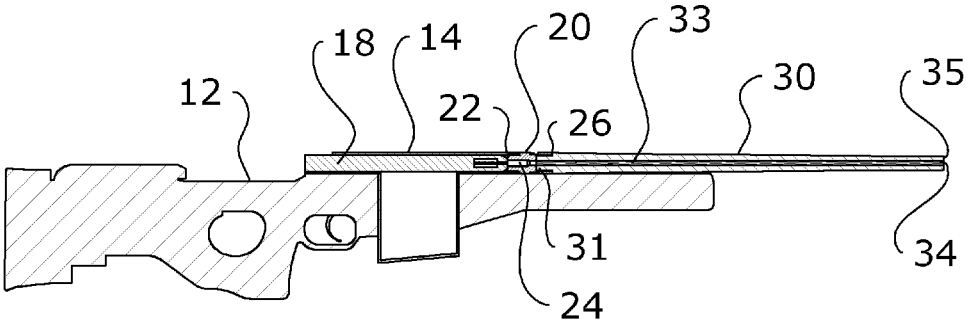
FIG. 11 is a cross sectional view taken along line 11-11 of FIG. 1.
Figure 12:
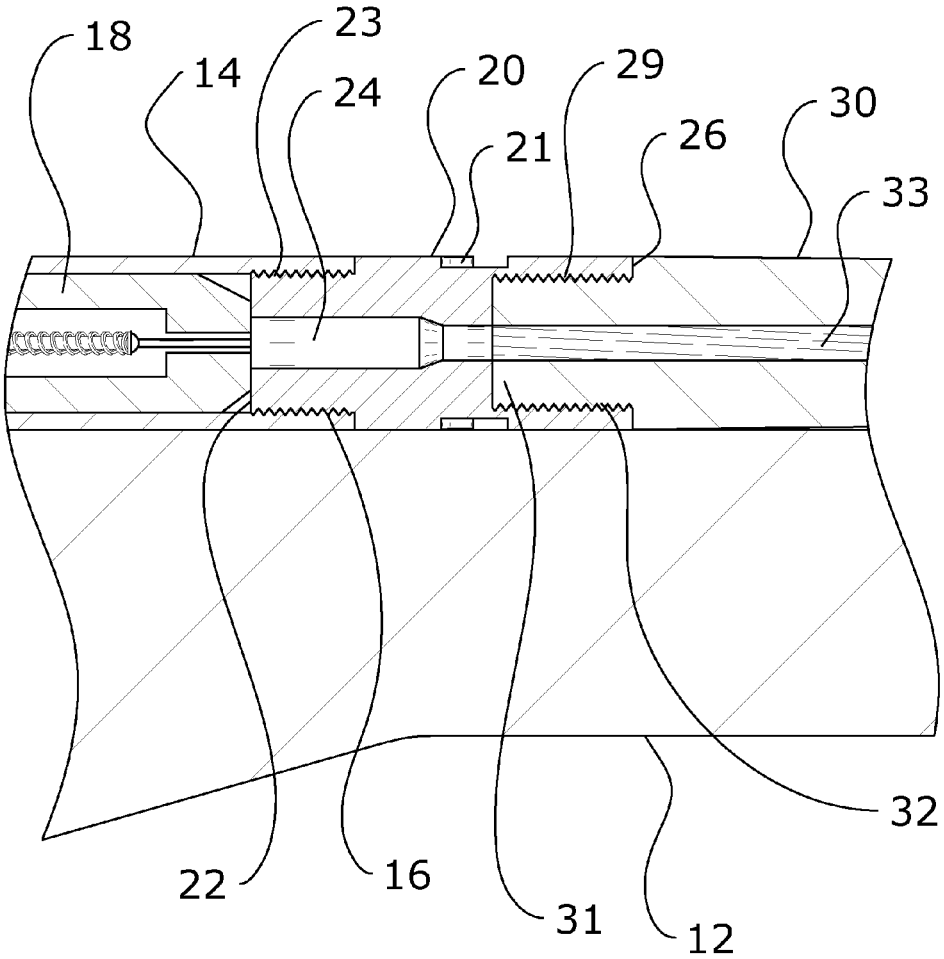
FIG. 12 is a magnified cross sectional view of FIG. 11 illustrating the chamber body connected to the receiver and the barrel.
Figure 13:
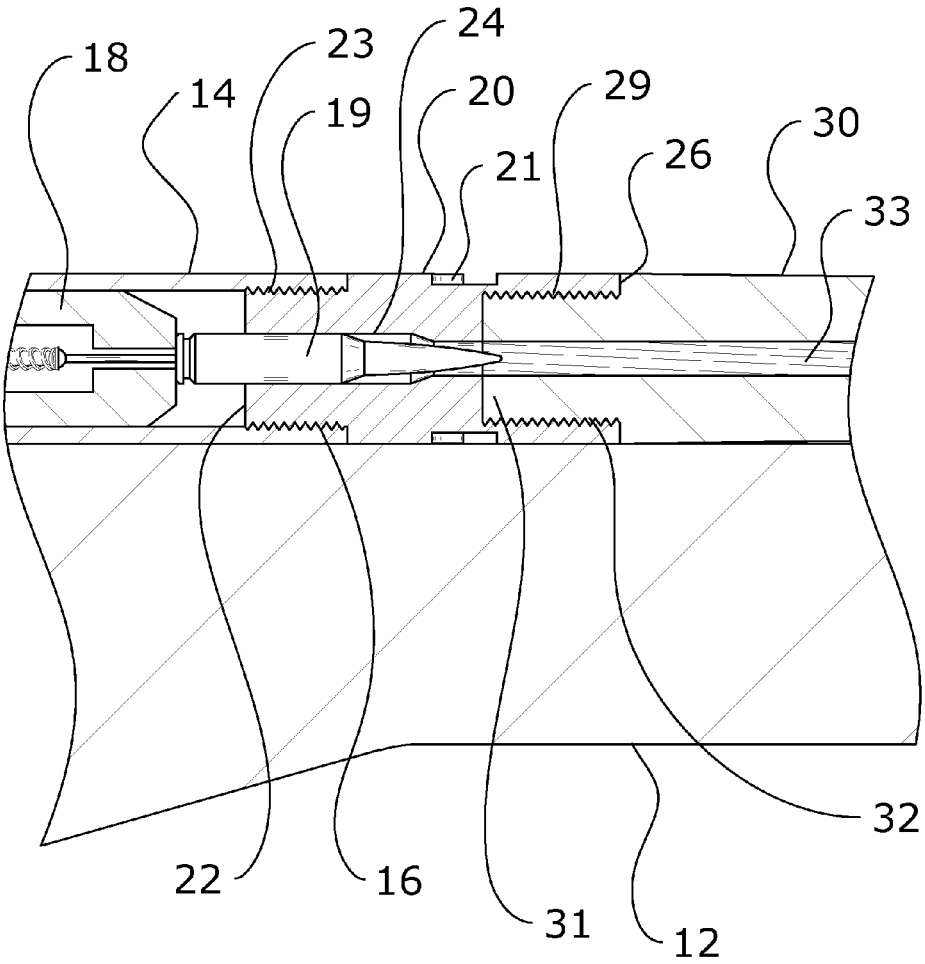
FIG. 13 is a magnified cross sectional view of FIG. 11 illustrating an ammunition cartridge within the chamber of the chamber body.

In use, the user selects the desired caliber of ammunition cartridge 19 they desire to fire and the desired length of barrel 30 to use for their firearm. The user then connects the barrel 30 in a threaded manner to the chamber body 20 as illustrated in FIG. 10 of the drawings. The user then connects the chamber body 20 (along with the barrel 30) in a threaded manner to the receiver 14 using a tool. It can be appreciated that the chamber body 20 may be first attached to the receiver 14 followed by the barrel 30 being attached to the chamber body 20. Once the chamber body 20 is fully secured to the receiver 14 of the firearm, the user is able to insert an ammunition cartridge 19 within the chamber 24 and fire the ammunition cartridge 19 thereby forcing the bullet through the bore 33 of the barrel 30.

After repeated usage, the bore 33 of the barrel 30 may become worn and require replacement. The user simply purchases a new barrel 30, removes the original barrel 30 from the chamber body 20, and then installs the new barrel 30 onto the chamber body 20. In addition, the chamber body 20 may become worn or damaged requiring replacement. Similar to replacing the barrel 30, the user purchases a new chamber body 20, removes the old chamber body 20 from the receiver 14 of the rifle and the barrel 30, and then installs the new chamber body 20 between the receiver 14 and the barrel 30. These processes may be used to replace the barrel 30 and/or the chamber body 20 at any time for any reason.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. An interchangeable chamber for a firearm, comprising:

a chamber body having a first end and a second end, wherein said first end of said chamber body includes a first connector adapted to be interchangeably connected to a receiver of a firearm and wherein said second end includes a second connector adapted to be interchangeably connected to a barrel;

wherein said first connector is comprised of a threaded connector and wherein said second connector is comprised of a threaded connector;

a first opening extending into said first end of said chamber body;

a second opening extending into said second end of said chamber body; and a chamber within said chamber body, wherein said chamber includes a body portion extending forward from a first end of said chamber, a tapering shoulder extending forwardly from said body portion, and a neck extending forwardly from said tapering shoulder to a second end of said chamber, wherein said body portion of said chamber is adapted to receive a case body of an ammunition cartridge, wherein said tapering shoulder of said chamber is adapted to receive a case neck of said ammunition cartridge, wherein said neck of said chamber is adapted to completely receive a case neck of said ammunition cartridge, wherein said chamber is connected to said first opening at said first end of said chamber and said second opening at said second end of said chamber, wherein said chamber is completely within said chamber body, and wherein said chamber is adapted to receive at least a portion of said ammunition cartridge such that said second end of said chamber is forward of a distal end of said case neck of said ammunition cartridge.

2. The interchangeable chamber of claim 1, wherein said first opening is part of said chamber.

3. The interchangeable chamber of claim 1, wherein said chamber body is constructed of a unitary piece of metal.

4. The interchangeable chamber of claim 1, wherein said chamber body includes a plurality of gripping members for selective engagement by a tool.

5. The interchangeable chamber of claim 1, wherein said first connector is comprised of outer threading surrounding a portion of said first end of said chamber body.

6. The interchangeable chamber of claim 5, wherein said second connector is comprised of interior threading within said second opening.

7. The interchangeable chamber of claim 1, wherein said second connector is comprised of interior threading within said second opening.

8. The interchangeable chamber of claim 1, wherein said first opening, said chamber and said second opening are concentric.

9. The interchangeable chamber of claim 1, wherein said second opening extends inwardly to a distal end of said neck of said chamber.

10. The interchangeable chamber of claim 9, wherein a diameter of said second opening is larger than a diameter of said neck of said chamber.

11. An interchangeable chamber body and barrel for a firearm, comprising:

a barrel having an inner end, a muzzle end and a bore extending between said inner end and said muzzle end, wherein said inner end includes an inner connector;

a chamber body having a first end and a second end, wherein said first end of said chamber body includes a first connector adapted to be interchangeably connected to a receiver of a firearm and wherein said second end includes a second connector that is interchangeably connected to said inner connector of said barrel;

wherein said first connector is comprised of a threaded connector and wherein said second connector is comprised of a threaded connector;

a first opening extending into said first end of said chamber body;

a second opening extending into said second end of said chamber body; and a chamber within said chamber body, wherein said chamber includes a body portion extending forward from a first end of said chamber, a tapering shoulder extending forwardly from said body portion, and a neck extending forwardly from said tapering shoulder to a second end of said chamber, wherein said body portion of said chamber is adapted to receive a case body of an ammunition cartridge, wherein said tapering shoulder of said chamber is adapted to receive a case neck of said ammunition cartridge, wherein said neck of said chamber is adapted to completely receive a case neck of said ammunition cartridge, wherein said chamber is connected to said first opening at said first end of said chamber and said second opening at said second end of said chamber, wherein said chamber is completely within said chamber body, and wherein said chamber is adapted to receive at least a portion of said ammunition cartridge such that said second end of said chamber is forward of a distal end of said case neck of said ammunition cartridge.

12. The interchangeable chamber and barrel of claim 11, wherein said first opening is part of said chamber.

13. The interchangeable chamber and barrel of claim 11, wherein said chamber body is constructed of a first unitary piece of metal and wherein said barrel is constructed of a second unitary piece of metal separate of said first unitary piece of metal.

14. The interchangeable chamber and barrel of claim 11, wherein said chamber body includes a plurality of gripping members for selective engagement by a tool.

15. The interchangeable chamber and barrel of claim 11, wherein said first connector is comprised of outer threading surrounding a portion of said first end of said chamber body that is adapted to threadably connect to an interiorly threaded receiver opening in said receiver.

16. The interchangeable chamber and barrel of claim 15, wherein said second connector is comprised of interior threading within said second opening and wherein said inner connector of said barrel is comprised of outer threading that threadably connects to said interior threading of said second connector.

17. The interchangeable chamber and barrel of claim 11, wherein said second connector is comprised of interior threading within said second opening.

18. The interchangeable chamber and barrel of claim 11, wherein said first opening, said chamber, said second opening and said bore are concentric.

19. The interchangeable chamber and barrel of claim 11, wherein said second opening extends inwardly to a distal end of a neck of said chamber.

20. The interchangeable chamber and barrel of claim 19, wherein a diameter of said second opening is larger than a diameter of said neck of said chamber.

21. An interchangeable chamber body and barrel for a firearm, comprising:

a barrel having an inner end, a muzzle end and a bore extending between said inner end and said muzzle end, wherein said inner end includes an inner connector;

a chamber body having a first end and a second end, wherein said first end of said chamber body includes a first connector adapted to be interchangeably connected to a receiver of a firearm and wherein said second end includes a second connector that is connected to said inner connector of said barrel;

wherein said first connector is comprised of a threaded connector and wherein said second connector is comprised of a threaded connector;

a first opening extending into said first end of said chamber body;

a second opening extending into said second end of said chamber body; and a chamber within said chamber body, wherein said chamber includes a body portion extending forward from a first end of said chamber, a tapering shoulder extending forwardly from said body portion, and a neck extending forwardly from said tapering shoulder to a second end of said chamber, wherein said body portion of said chamber is adapted to receive a case body of an ammunition cartridge, wherein said tapering shoulder of said chamber is adapted to receive a case neck of said ammunition cartridge, wherein said neck of said chamber is adapted to completely receive a case neck of said ammunition cartridge, wherein said chamber is connected to said first opening at said first end of said chamber and said second opening at said second end of said chamber, wherein said chamber is completely within said chamber body, and wherein said chamber is adapted to receive at least a portion of said ammunition cartridge such that said second end of said chamber is forward of a distal end of said case neck of said ammunition cartridge.

22. The interchangeable chamber and barrel of claim 21, wherein said second connector is interchangeably connected to said inner connector of said barrel.

* * * * *